US007793667B2

(12) United States Patent
Gayton et al.

(10) Patent No.: US 7,793,667 B2
(45) **Date of Patent: *Sep. 14, 2010**

(54) METHOD AND DEVICE FOR APPLYING HAIR COLOR

(76) Inventors: Karen L. Gayton, 829 Thompson Bridge Rd., Gainesville, GA (US) 30501; Stephen Heath Gayton, 829 Thompson Bridge Rd., Gainesville, GA (US) 30501

( * ) Notice: Subject to any disclaimer, the term of this patent is extended or adjusted under 35 U.S.C. 154(b) by 0 days.

This patent is subject to a terminal disclaimer.

(21) Appl. No.: 11/463,971

(22) Filed: Aug. 11, 2006

(65) Prior Publication Data

US 2008/0041739 A1 Feb. 21, 2008

(51) Int. Cl.
*A45D 24/22* (2006.01)
*B65D 25/08* (2006.01)

(52) U.S. Cl. ..... 132/112; 206/219

(58) Field of Classification Search ..... 132/112–116, 132/108, 208; 222/83, 129, 83.5, 85, 86; 401/133, 134; 206/219
See application file for complete search history.

(56) References Cited

U.S. PATENT DOCUMENTS 3,290,017 A * 12/1966 Davies et al. ..... 366/130
4,875,577 A * 10/1989 Hildebrandt et al. ..... 206/219
5,937,864 A * 8/1999 Diaz ..... 132/112
6,189,688 B1 * 2/2001 Aneas ..... 206/219
6,976,494 B2 * 12/2005 Wayne et al. ..... 132/108
7,258,091 B2 * 8/2007 Abe ..... 123/90.39
2005/0072442 A1 * 4/2005 Licari et al. ..... 132/112
2006/0113318 A1 * 6/2006 May et al. ..... 222/94

* cited by examiner

*Primary Examiner*—Robyn Doan
(74) *Attorney, Agent, or Firm*—Smith, Gambrell & Russell

(57) ABSTRACT

A device and method for coloring hair having at least one breakable ampoule contained within a larger container. The ampoule or ampoules are broken to release their contents, which combine to produce a hair coloring solution. The larger container has a brush or sponge like filter applicator through which the hair coloring solution can be dispensed directly onto the chosen hair area. The larger container preferably is manufactured from a squeezable material such as a polymer so that the larger container can be squeezed to assist in dispensing the hair color solution. The ampoules preferably are manufactured from a breakable material such that the ampoules can be broken and their contents released into the larger container.

24 Claims, 10 Drawing Sheets

METHOD AND DEVICE FOR APPLYING HAIR COLOR

BACKGROUND OF THE INVENTION

1. Technical Field

The present invention generally is in the field of coloring hair, and more particularly is in the field of portable, disposable devices for coloring hair regrowth, particularly hair roots, and methods for coloring hair using such devices.

2. Prior Art

Salon owners continuously hear complaints from salon clients that their hair regrowth starts appearing shortly after receiving beautiful, expensive, professional color. More specifically, as human hair is in a continuous state of growth, very soon after a salon client has her or his hair colored, the salon client's hair roots begin to show, and the hair roots are not the colored, but are the salon client's original hair color. This can lead to multi-colored hair and public knowledge that the salon client is coloring her or his hair.

Currently, to avoid the hair regrowth from showing, the salon client has several choices for maintaining the color of the hair and for coloring the regrowth of hair roots. One such choice is commercially available hair colorants, such as those that can be purchased in the store. However, many salon clients will not use such products in fear that it will ruin the professional color. Additionally, such commercially available products can be messy and difficult to apply to the hair, and even messier and more difficult to apply just to the hair root. Further, the color choices currently on the market often will not allow the salon client a precise match to the professional color, and the salon client has to guess the quantity to apply, and has to mix various colors and other chemicals and solutions together, which can be a hit or miss process. Therefore, the use of such commercially available products is not a satisfactory option of many salon clients.

Another choice is to continuously visit the salon for hair color touch ups between major coloring visits. During such interim visits, the salon professional can color the hair root regrowth using the professional color originally used on the hair. However, such interim visits can be both time-consuming and expensive. The salon client must take time out of her or his day one a week or once every other week for such interim visits. Additionally, the salon professional often must charge the salon client for each such interim visit. Currently, many clients go to the salon every two to four weeks in need of such small but noticeable regrowth touch-ups, and in many cases, just a small perimeter touch-up. For the salon professional, this is a low profit activity and for the salon client, this is a high cost and time consuming activity. Therefore, such interim visits also are not a satisfactory option for many salon clients.

Accordingly, there is a need for a device and method that allows for the home coloring of hair regrowth, and especially hair root growth, between salon visits. There is also a need for such a device and method that is easy to use and to apply to the hair without messy or difficult mixing and application. There is a further need for such a device and method that is less costly and time-consuming than an equivalent visit to the salon for professional coloring touch-ups. There is an additional need for such a device and method that uses the same color formulation that was use by the salon professional for the initial hair coloring. There is also a need for such a device and method that is portable and compact such that the salon client can carry the device on her or his person or while traveling and can use the device and carry out the method without the need of additional devices. It is to these needs and others that the present invention is directed.

BRIEF SUMMARY OF THE INVENTION

Briefly described, the present invention is a one-step, economical, precise way for the salon client to just touch-up regrowth of hair without causing damage to the rest of the hair. The present invention is suitable for use with most hair growth, including head hair, eyebrows, mustaches and beards. Currently, to the best of the inventor's knowledge and belief, there is nothing on the market that does not include a specific mixing step and that allows the salon client to apply the hair colorant to a precise area without effecting unwanted areas.

A first embodiment of the device of the present invention comprises a breakable ampoule of a first solution, such as the colorant, contained within a larger container also containing a second solution, such as a carrier. The carrier preferably is a peroxide, as the combination of a hair colorant and a peroxide produces a permanent hair coloring solution. The larger container further comprises a brush or sponge like filter through which the hair coloring solution can be dispensed directly onto the chosen hair area and preferably is manufactured from a squeezable material such as a polymer so that the larger container can be squeezed to assist in dispensing the hair color solution. The ampoule preferably is manufactured from a breakable material such that the ampoule can be broken and its contents released into the larger container.

A second embodiment of the device of the present invention comprises a first breakable ampoule of a first solution, such as the colorant, and a second ampoule of a second solution, such as the carrier, both contained within a larger container. The carrier preferably is a peroxide, as the combination of a hair colorant and a peroxide produces a permanent hair coloring solution. Alternatively, the second ampoule also can contain the hair colorant or a second shade of hair colorant, and the larger container can contain the carrier. The larger container further comprises a brush or sponge like filter through which the hair coloring solution can be dispensed directly onto the chosen hair area and preferably is manufactured from a squeezable material such as a polymer so that the larger container can be squeezed to assist in dispensing the hair color solution. The ampoules preferably are manufactured from a breakable material such that the ampoules can be broken and their contents released into the larger container.

A third embodiment of the device of the present invention comprises a first breakable ampoule of a first solution, such as the colorant, a second ampoule of a second solution, such as the carrier, and one or more additional ampoules of additional solutions such as conditioners, oils or other hair care products, all contained within a larger container. Alternatively or additionally, the second and/or additional ampoules also can contain the hair colorant or a second shade of hair colorant and the larger container can contain one of the solutions. The carrier preferably is a peroxide, as the combination of a hair colorant and a peroxide produces a permanent hair coloring solution. The larger container further comprises a brush or sponge like filter through which the hair coloring solution can be dispensed directly onto the chosen hair area and preferably is manufactured from a squeezable material such as a polymer so that the larger container can be squeezed to assist in dispensing the hair color solution. The ampoules preferably are manufactured from a breakable material such that the ampoules can be broken and their contents released into the larger container.

A first embodiment of the method of the present invention comprises the steps of (1) providing a device having at least one breakable ampoule of a first solution, such as the colorant, contained within a larger relatively flexible container also containing a second solution, such as a carrier; (2) breaking the ampoule so as to release the first solution into the larger container; (3) mixing the first solution with the second solution within the larger container so as to produce a permanent hair color solution; and (4) squeezing the larger container to dispense the hair color solution. The carrier preferably is a peroxide, as the combination of a hair colorant and a peroxide produces a permanent hair coloring solution. The larger container further comprises a brush or sponge like filter through which the hair coloring solution can be dispensed directly onto the chosen hair area and preferably is manufactured from a squeezable material such as a polymer so that the larger container can be squeezed to assist in dispensing the hair color solution. The ampoule preferably is manufactured from a breakable material such that the ampoule can be broken and its contents released into the larger container.

A second embodiment of the method of the present invention comprises the steps of (1) providing a device having at least two breakable ampoules, a first ampoule of a first solution, such as the colorant, and a second ampoule of a second solution, such as a carrier, with both ampoules being contained within a larger relatively flexible container; (2) breaking the ampoules so as to release the first solution and the second solution into the larger container; (3) mixing the first solution with the second solution within the larger container so as to produce a permanent hair color solution; and (4) squeezing the larger container to dispense the hair color solution. The carrier preferably is a peroxide, as the combination of a hair colorant and a peroxide produces a permanent hair coloring solution. The larger container further comprises a brush or sponge like filter through which the hair coloring solution can be dispensed directly onto the chosen hair area and preferably is manufactured from a squeezable material such as a polymer so that the larger container can be squeezed to assist in dispensing the hair color solution. The ampoule preferably is manufactured from a breakable material such that the ampoule can be broken and its contents released into the larger container.

A third embodiment of the method of the present invention comprises the steps of (1) providing a device having at least two ampoules, a first ampoule of a first solution, such as the colorant, a second ampoule of a second solution, such as a carrier, and either (a) a third ampoule of a third solution, such as a conditioner, oil or other hair care product or (b) a conditioner, oil or other hair care product, all contained within a larger relatively flexible container; (2) breaking the ampoules so as to release the first solution, the second solution, and, if the third solution is contained in an ampoule, the third solution into the larger container; (3) mixing the first solution, the second solution, and the third solution within the larger container so as to produce a permanent hair color solution; and (4) squeezing the larger container to dispense the hair color solution. The carrier preferably is a peroxide, as the combination of a hair colorant and a peroxide produces a permanent hair coloring solution. The larger container further comprises a brush or sponge like filter through which the hair coloring solution can be dispensed directly onto the chosen hair area and preferably is manufactured from a squeezable material such as a polymer so that the larger container can be squeezed to assist in dispensing the hair color solution. The ampoule preferably is manufactured from a breakable material such that the ampoule can be broken and its contents released into the larger container. This third embodiment also can have four or more ampoules and/or solutions.

One feature of the present invention is a consumer friendly device and method for the salon client who has had professional hair color applied to maintain the hair color, and especially the hair root regrowth color, between salon visits. Another feature of the present invention is a device and method allowing for the application of hair color to a precise area of hair without having to worry about applying color to unwanted areas of hair. Yet another feature of the present invention is a device and method for applying a pre-set color and amount of hair color and other hair care ingredients to a precise area of hair. Still another feature of the present invention is a low cost, economical, and simple to use device and method for the application of hair color.

These features, and other features and advantages of the present invention will become more apparent to those of ordinary skill in the relevant art when the following detailed description of the preferred embodiments is read in conjunction with the appended drawings in which like reference numerals represent like components throughout the several views.

DETAILED DESCRIPTION OF THE PREFERRED EMBODIMENTS

Figure 1:
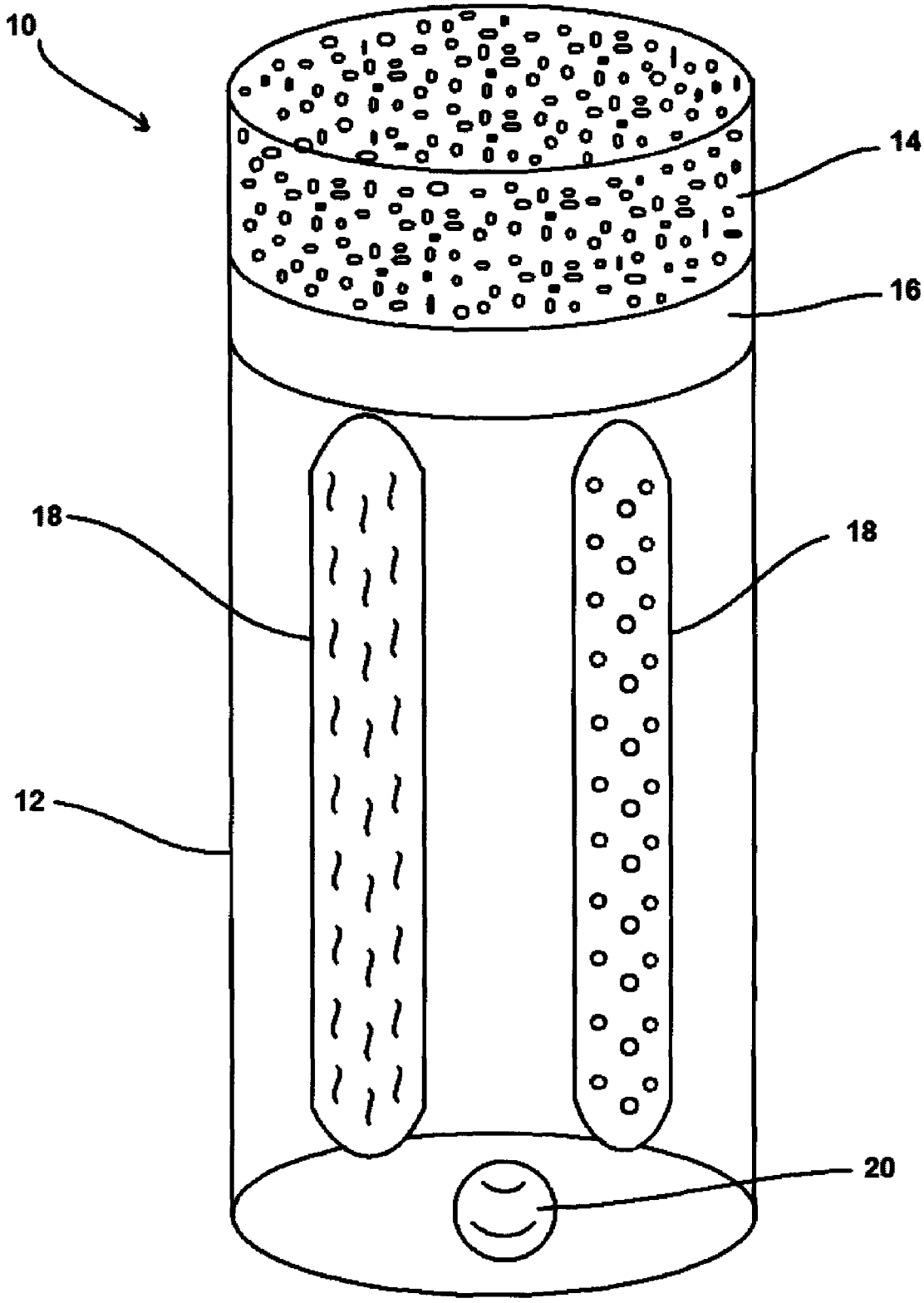
FIG. 1 is a perspective view of a first embodiment of the present invention.
Figure 2:
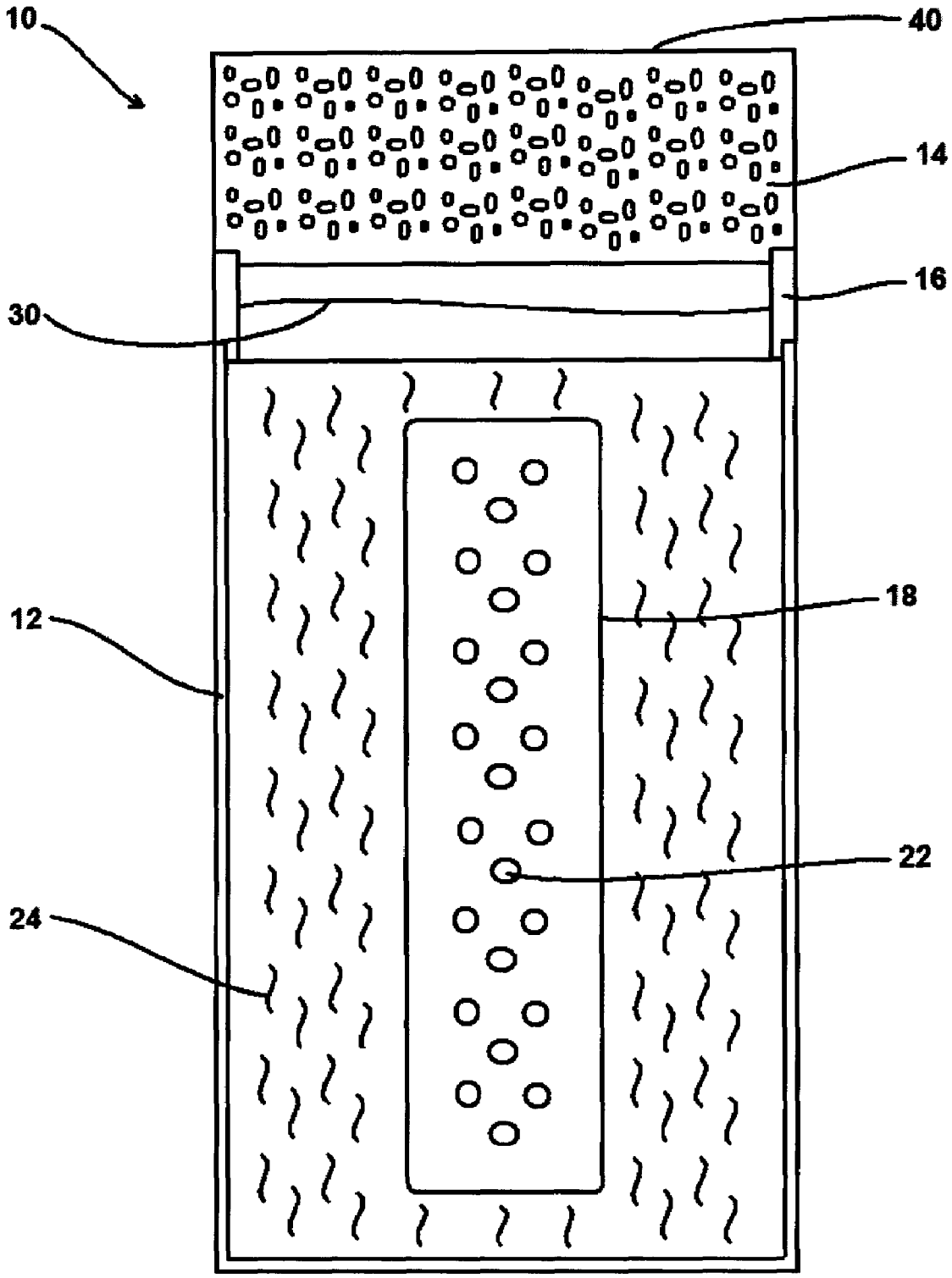
FIG. 2 is a sectional side view of an embodiment of the present invention having a single ampoule and a sponge applicator.
Figure 3:
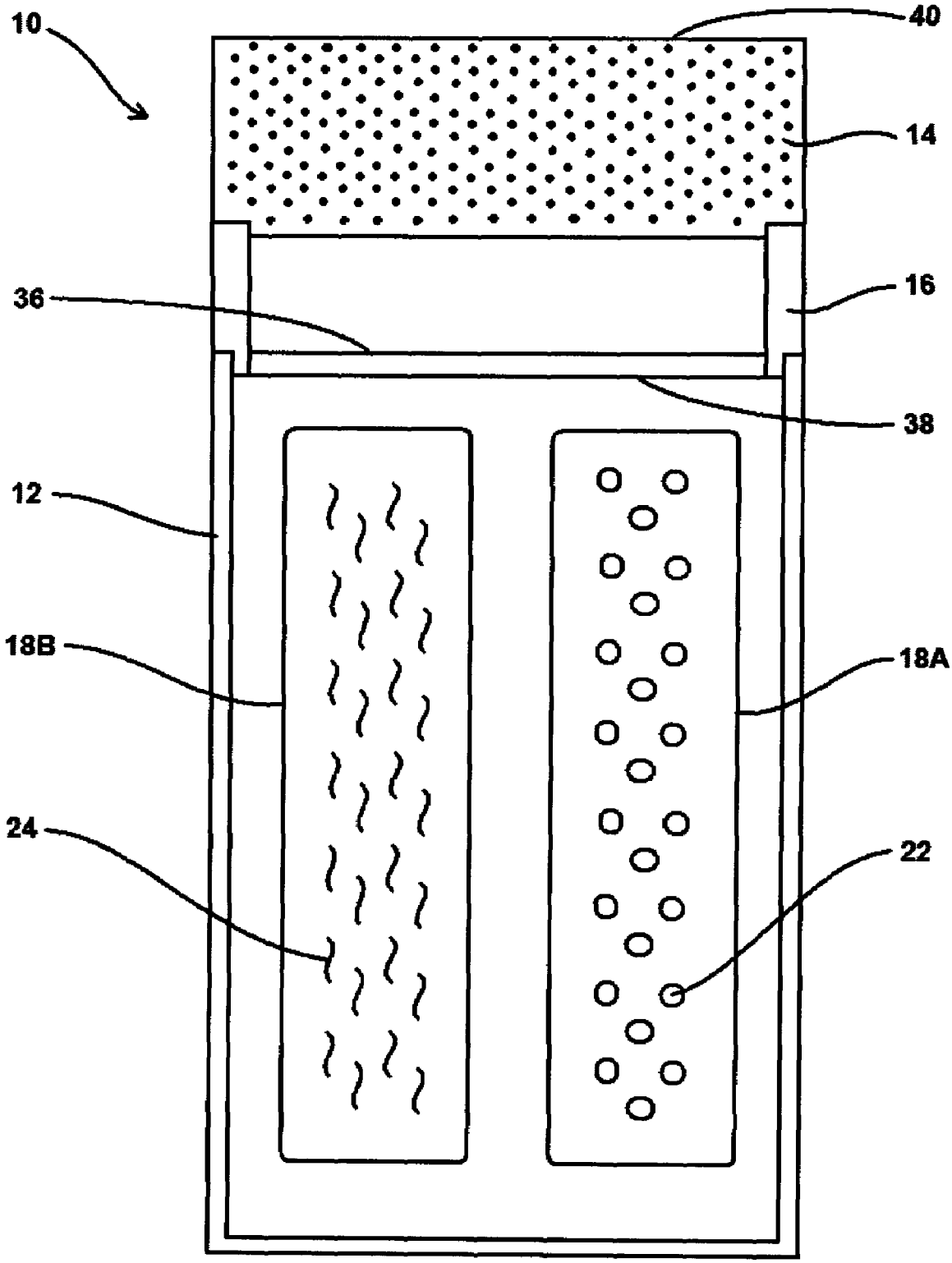
FIG. 3 is a sectional side view of a first embodiment of the present invention having two ampoules and a flat filter applicator.
Figure 4:
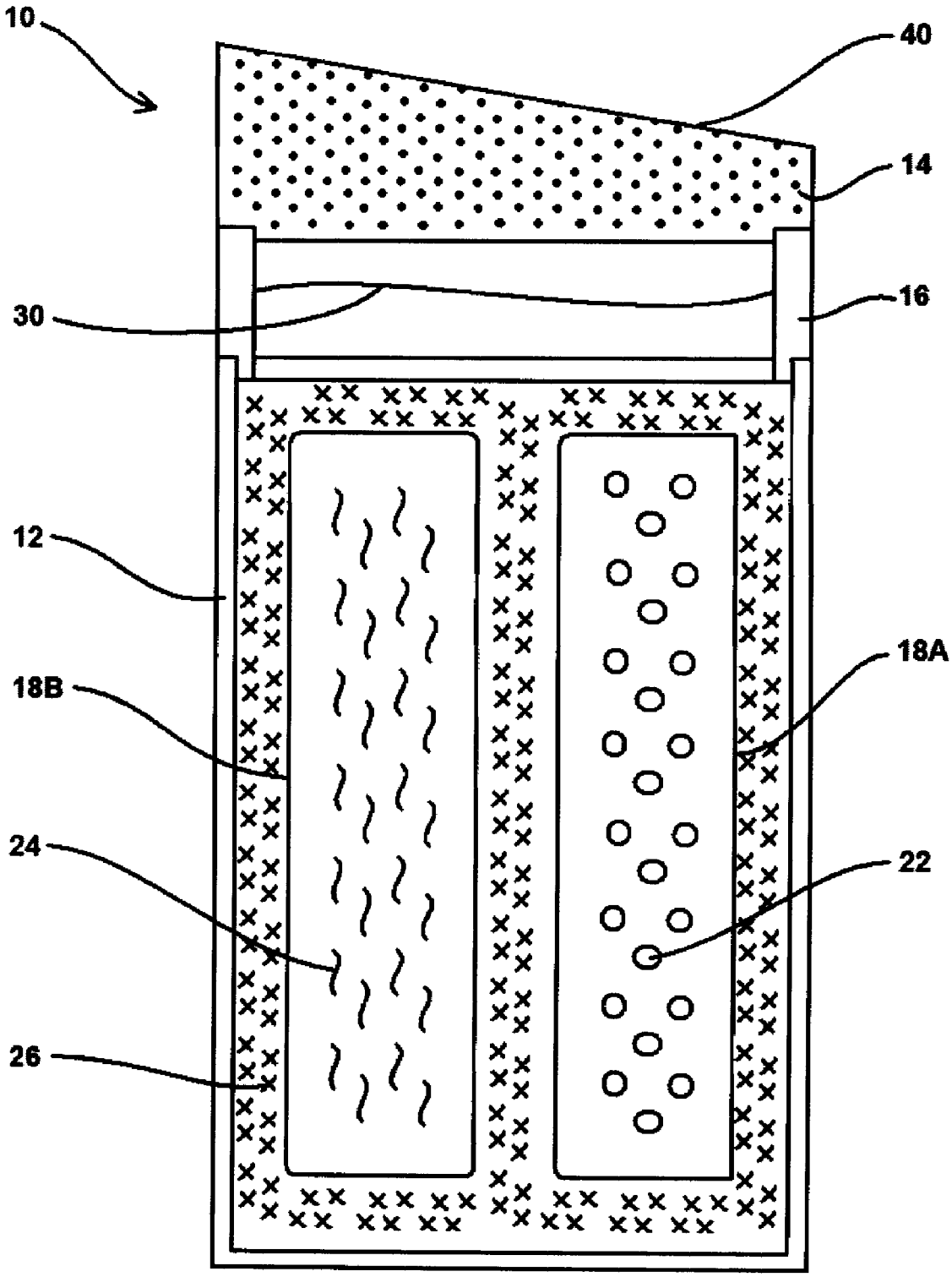
FIG. 4 is a sectional side view of a second embodiment of the present invention having two ampoules and a tapered filter applicator.

Illustrative embodiments of a device and method for applying color to hair according to the present invention are shown in FIGS. 1 through 9. FIG. 1 is a perspective view of a first embodiment of the present invention illustrating an example of a basic configuration. FIG. 2 is a sectional side view of an embodiment of the present invention having a single ampoule and a sponge applicator in which the hair colorant in contained in the ampoule and the carrier is contained in the larger container. FIG. 3 is a sectional side view of a first embodiment of the present invention having two ampoules and a flat filter applicator in which the hair colorant is contained in one ampoule and the carrier is contained in another ampoule. FIG. 4 is a sectional side view of a second embodiment of the present invention having two ampoules and a tapered filter applicator in which the hair colorant is contained in one ampoule and the carrier is contained in another ampoule and a third solution such as a conditioner is contained in the larger container.

Figure 5:
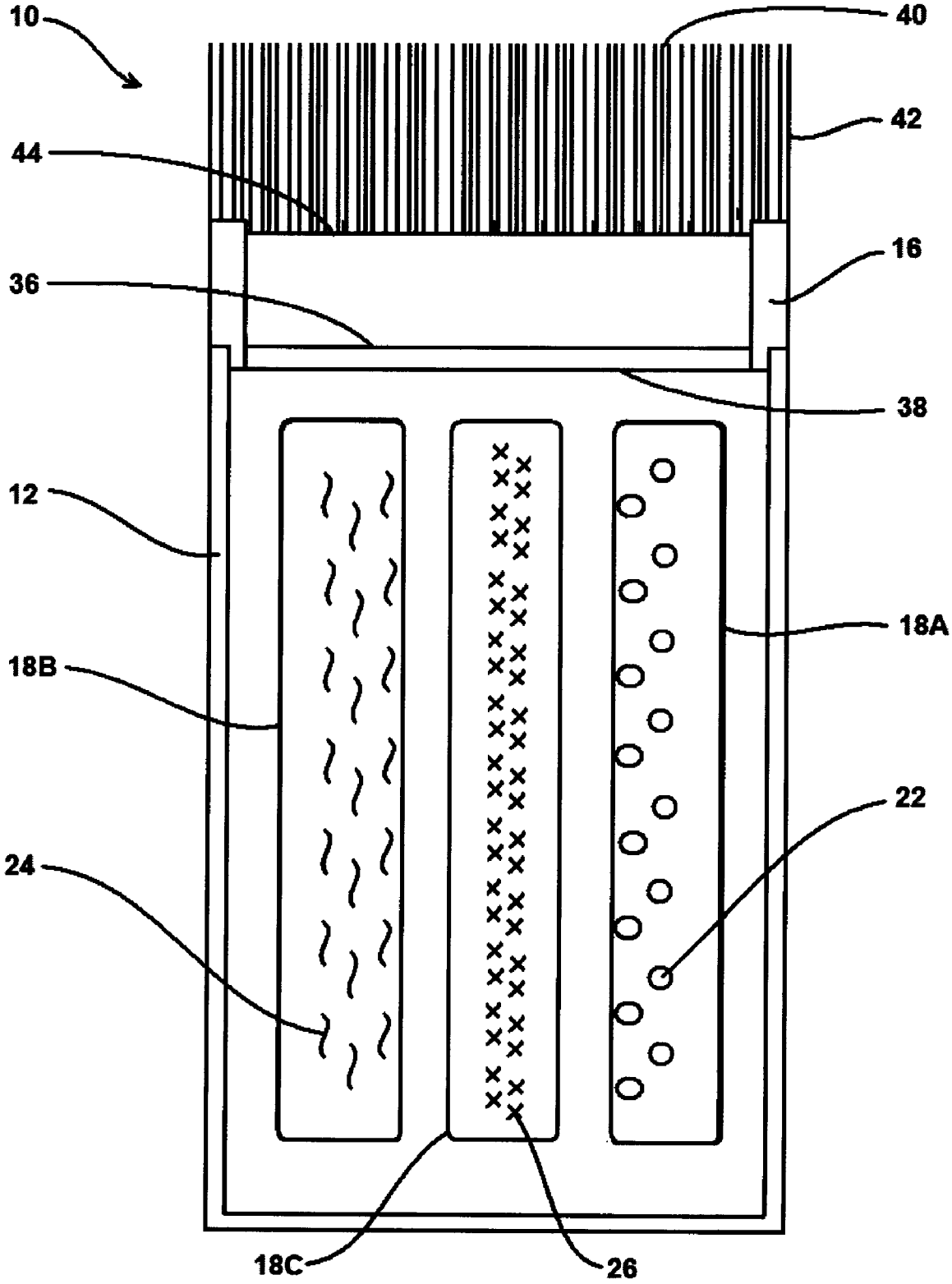
FIG. 5 is a sectional side view of a first embodiment of the present invention having three ampoules and a flat brush applicator.
Figure 6:
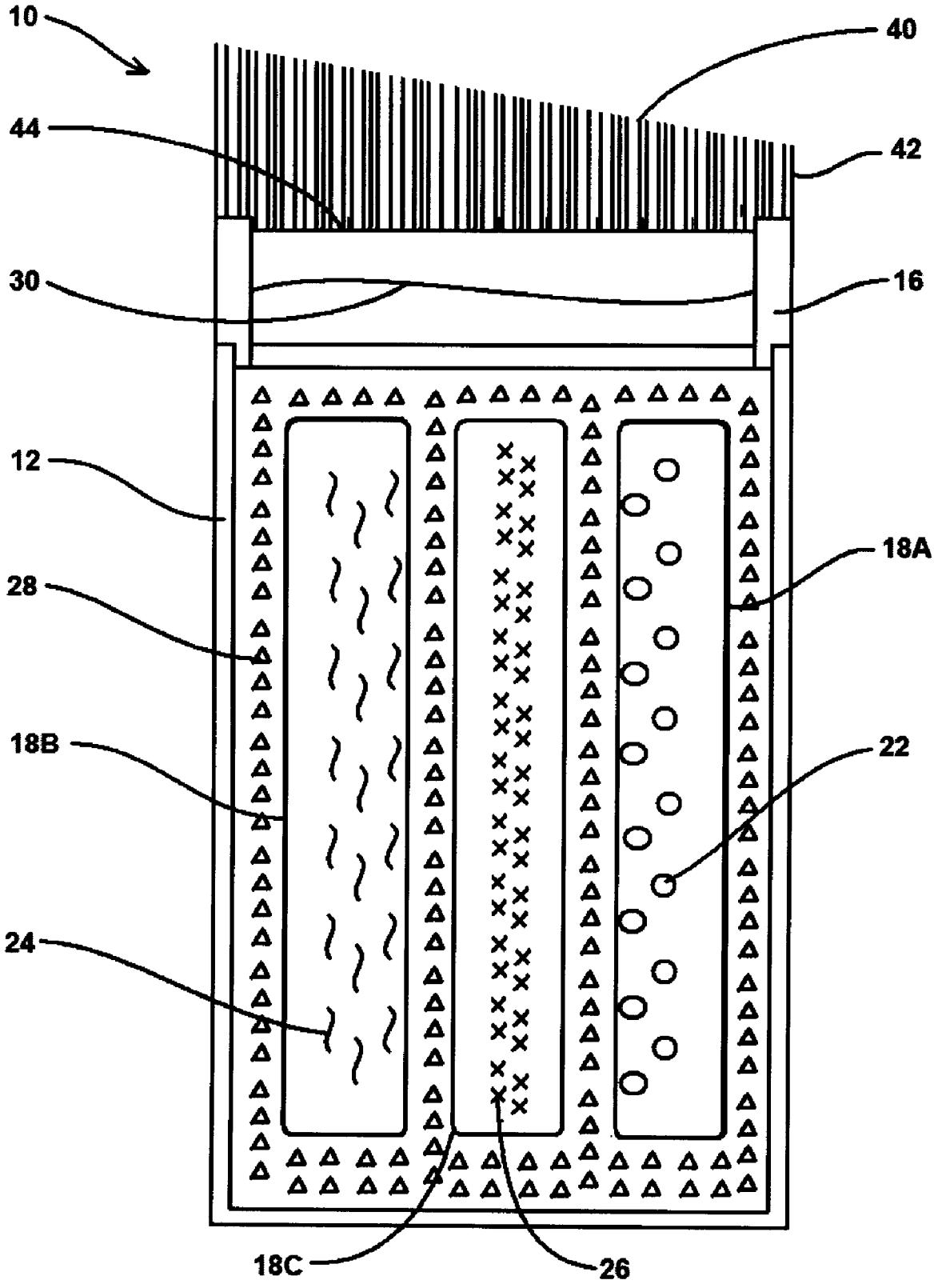
FIG. 6 is a sectional side view of a second embodiment of the present invention having three ampoules and a tapered brush applicator.
Figure 7:
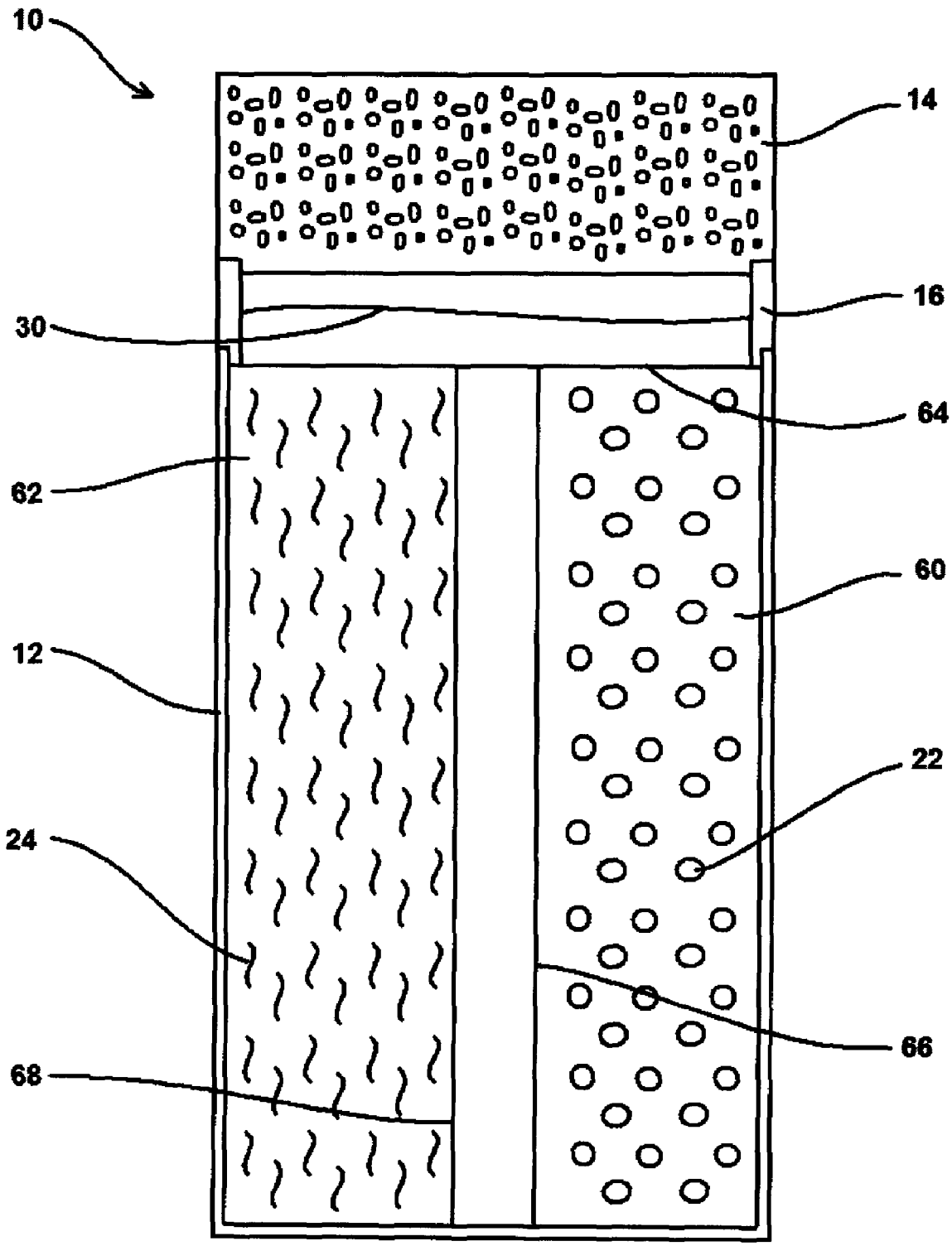
FIG. 7 is a sectional side view of an embodiment of the present invention having a multi-chambered container with a breakable separating membrane and a sponge applicator.
Figure 8:
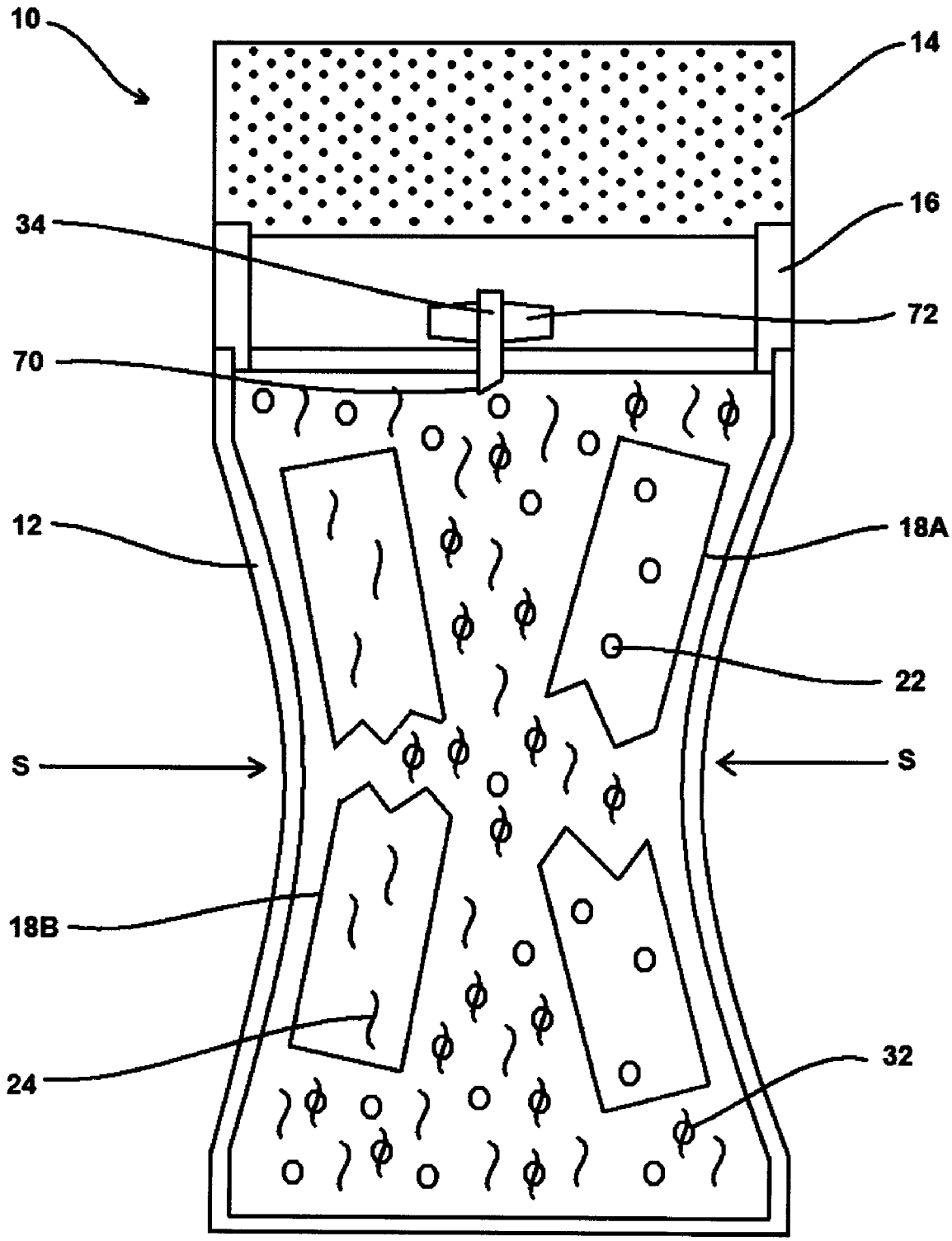
FIG. 8 is a sectional side view of the embodiment of the present invention shown in FIG. 3 with the two ampoules broken and the solutions mixed in preparation for use.
Figure 9:
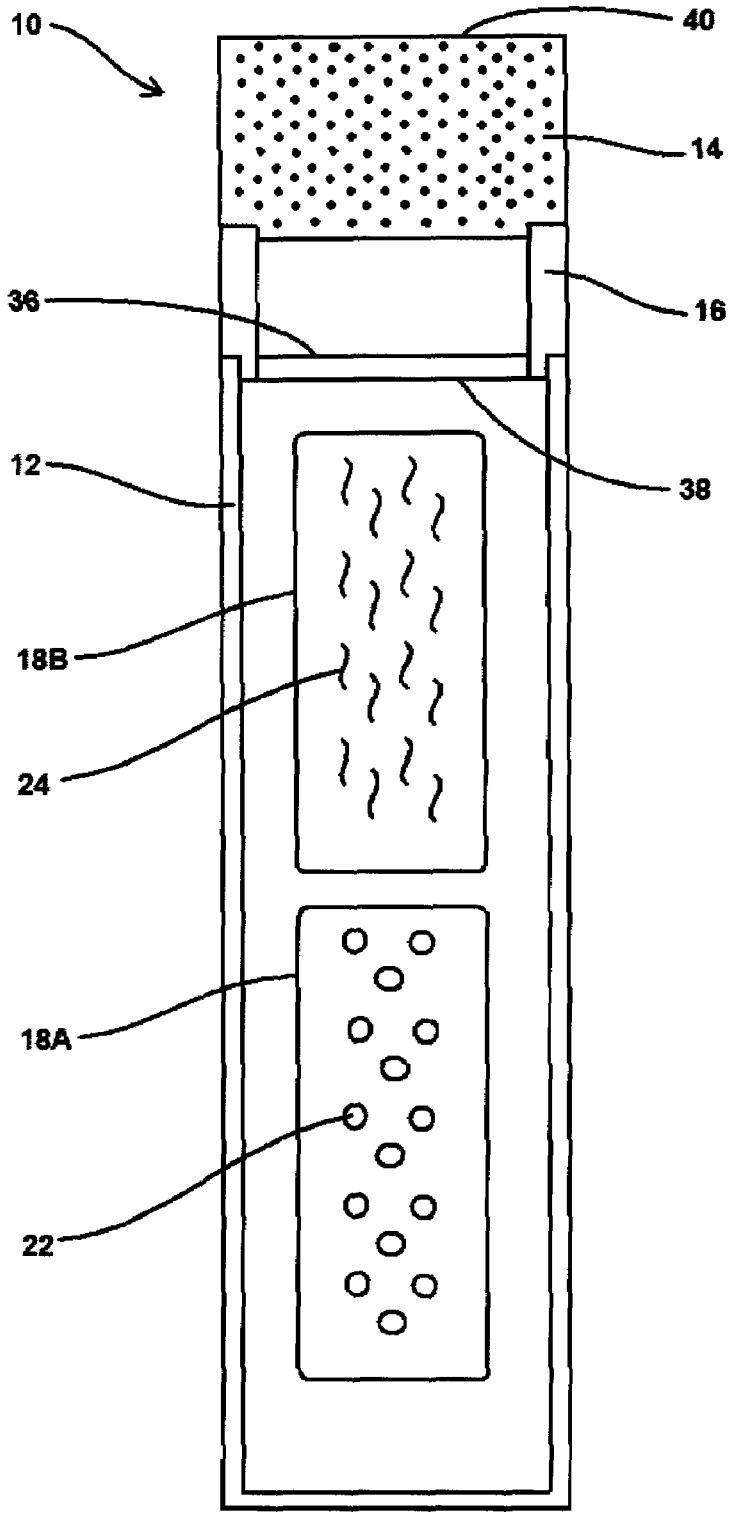
FIG. 9 is a sectional side view of an embodiment of the present invention having two ampoules in a stacked relationship.
Figure 10:
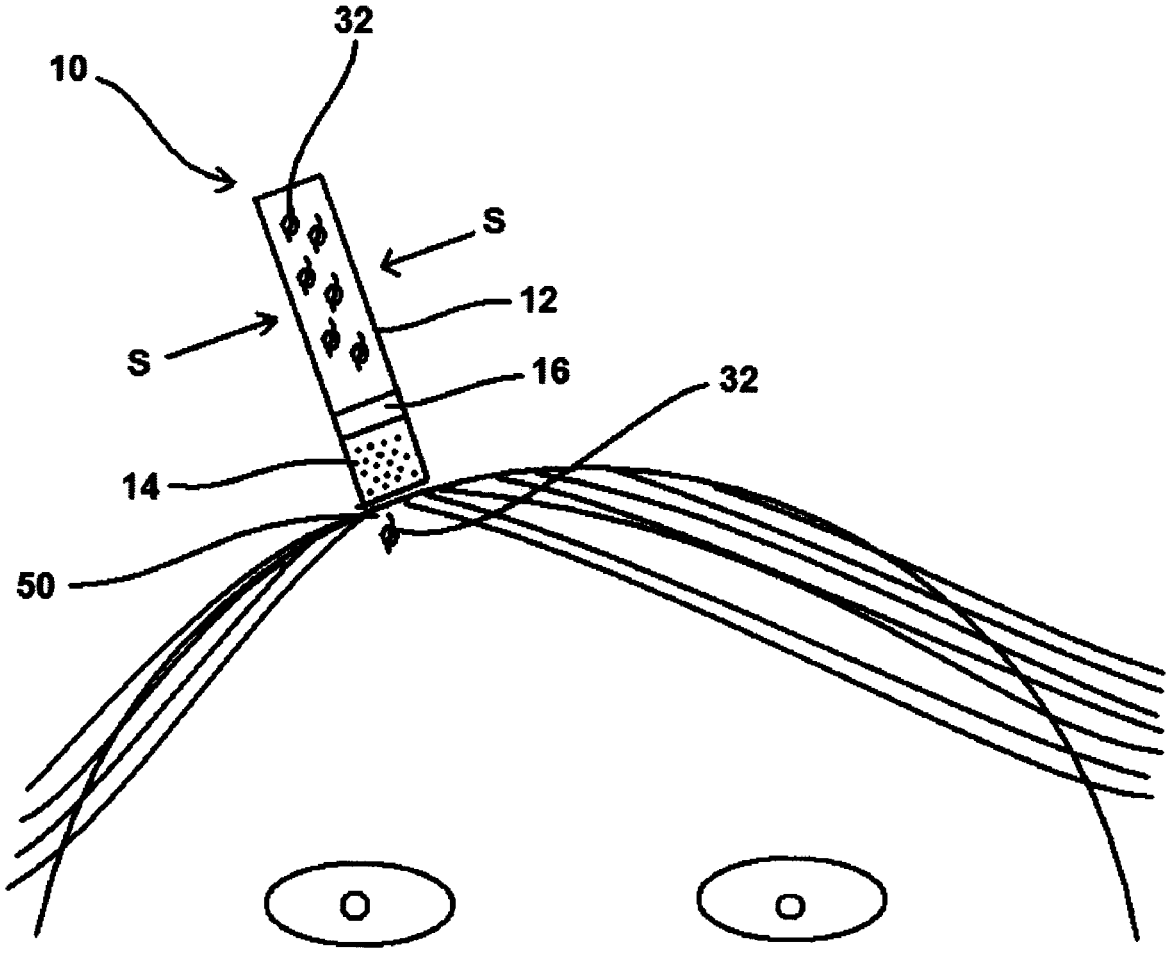
FIG. 10 is a perspective view of the present invention in use.

FIG. 5 is a sectional side view of a first embodiment of the present invention having three ampoules and a flat brush applicator in which the hair colorant is contained in one ampoule, the carrier is contained in another ampoule, and a third solution such as a conditioner is contained in a third ampoule. FIG. 6 is a sectional side view of a second embodiment of the present invention having three ampoules and a tapered brush applicator in which the hair colorant is contained in one ampoule, the carrier is contained in another ampoule, a third solution such as a conditioner is contained in a third ampoule, and a fourth solution such as an additional hair care product is contained in the larger container. FIG. 7 is a sectional side view of an embodiment of the present invention having a multi-chambered container with a breakable separating membrane and a sponge applicator. FIG. 8 is a sectional side view of the embodiment of the present invention shown in FIG. 3 with the two ampoules broken and the solutions mixed in preparation for use, and also showing the use of a puncture device. FIG. 9 is a sectional side view of an embodiment of the present invention having two ampoules in a stacked relationship. FIG. 10 is a perspective view of the present invention in use.

The present invention is a one-step, economical, precise way for the salon client to just touch-up regrowth of hair without causing damage to the rest of the hair. The present invention is suitable for use with most hair growth, including head hair, eyebrows, mustaches and beards. Currently, to the best of the inventor's knowledge and belief, there is nothing on the market that does not include a specific mixing step and that allows the salon client to apply the hair colorant to a precise area without effecting unwanted areas.

Referring now to FIG. 1, an illustrative example of the device 10 comprises a larger container 12, an applicator 14, and a connecting ring 16 for attaching the applicator 14 to the larger container 12. Within the container 12 are located at least one ampoule 18, two being shown in FIG. 1, and an optional mixing ball 20. As will be disclosed, various combinations of these components are contemplated in this invention. Further, throughout the drawings, hair colorant 22 is represented by circles (o), carrier 24 is represented by squiggly lines (~), a first additional hair care product such as conditioner 26 is represented by xs (x), and a second additional hair care product 28 is represented by triangles (Δ). The final hair color solution 32 is represented by a squiggly line overlaying a circle.

Hair colorant 22 can be any of the known or future developed hair colorants, and can be prepackaged in ampoule 18 in a known manner. Carrier 24 can be any carrier or catalyst useful for formulating hair coloring solution 32, and also can be prepackaged in ampoule 18 in a known manner. Suitable carriers include but are not limited to peroxide and ammonia and other known carriers and catalysts. Carrier 24 preferably is a peroxide, as the combination of hair colorant 22 and peroxide 24 produces a permanent hair coloring solution 32. Additional hair care products 28 include but are not limited to conditioners 26, oils, crèmes, dyes, tints, lotions, bleaches, mousses and the like.

Larger container 12 preferably is hollow, has a closed bottom and sides and an open top, has a length between approximately 1 inch and 4 inches, and a diameter or width between approximately ¼ inch and 1 inch. Larger container 12 can be somewhat larger or smaller; however, it is preferable that larger container 12 be of such a size that it can be easily manipulated by the user with one or two hands. More specifically, larger container 12 preferably is structured to hold and contain liquids. Large container 12 preferably is made from a flexible material such as an amorphous (non-crystalline) polymer such that larger container 12 can be squeezed by the salon client. Such materials are known in the art and include without limitation polyethylene terephthalate (PET) and high density polyethylene (HDPE). Other less flexible and rigid materials also can be used, but are not preferred.

Applicator 14 preferably is a material shaped to generally correspond to the cross sectional shape of larger container 12 such that applicator 14 can more easily be attached to larger container 12. Applicator 14 is manufactured from a material that will allow a fluid contained within larger container 12 to travel through applicator 14 in a controlled manner. Applicator 14 preferably is a material that falls within the general known categories of sponges, brushes, and filters that can be used as fluid or solution applicators. One of ordinary skill in the art can select an appropriate applicator 14 material for use with the hair color solution contained within larger container 12 and ampoules 18 without undue experimentation.

Connecting ring 16 is optional and can serve at least two purposes. First, connecting ring 16 can allow applicator 14 to be connected to larger container 12. Second, connecting ring 16 can comprise a breakable or puncturable membrane 30 (see FIG. 2) sealing larger container 12 closed. Connecting ring 16 is a ring-like structure having a side wall but no top or bottom walls and can be attached to larger container 12 via any conventional means, such as for example a screw thread or friction. Membrane 30 can be attached to connecting ring 16 via any conventional means, such as for example adhesive, heat welding, or sonic welding. Membrane 30 can be any suitable material such as a thin polymer. Such materials are known in the art and include without limitation low density polyethylene (LDPE). If used, membrane 30 is attached about the internal circumference or perimeter of connecting ring 16.

Ampoules 18 are relatively small breakable vials filled with a selected hair care product, preferably in solution or liquid form. Ampoules 18 are of such a size that at least one, and preferably two or more, ampoules 18 can fit within the hollow interior of larger container 12. Thus, ampoules 18 can be of various sizes so long as ampoules 18 fit within larger container 12. Ampoules 18 are structured to hold and contain liquids. Ampoules 18 preferably are made from a rigid material such as a crystalline or other brittle polymer or glass such that ampoules 18 can be broken, thus releasing the solutions contained within ampoules 18 when larger container 12 is squeezed by the salon client. Such materials are known in the art and include without limitation glass, ceramic, polyvinylchloride (PVC), polypropylene, and polystyrene. Other flexible and less rigid materials also can be used, but are not preferred.

Mixing ball 20 is a relatively small sphere or other shaped structure and is contained within larger container 12. The purpose of mixing ball 20, mixing ball 20 being optional, is to assist in mixing the solutions contained within ampoules 18 and larger container 12 together for application by the salon client.

Referring now to FIG. 2, a first embodiment of the device 10 of the present invention comprises a breakable ampoule 18 of a first solution, such as hair colorant 22, contained within larger container 12 also containing a second solution, such as carrier 24. Alternatively, as some hair colorants 22 do not need a carrier or catalyst, larger container 12 can contain only ampoule 18 containing hair colorant 22 and no second solution. Larger container 12 further comprises a sponge applicator 14 through which hair coloring solution 32 can be dispensed directly onto the chosen hair area 50 (see FIG. 9). As shown in this figure, sponge applicator 14 has a flat application surface 40. Larger container 12 preferably is manufactured from a squeezable material so that larger container 12 can be squeezed to assist in dispensing hair color solution 32. Ampoule 18 preferably is manufactured from a breakable material such that ampoule 18 can be broken and its contents released into larger container 12 (see FIG. 8). Connecting ring 16 in this example comprises membrane 30, which can be ruptured via pressure or via tube 34 (see FIG. 8). For example, after ampoule 18 is broken and hair colorant 22 is mixed with carrier 24 within larger container 12, further squeezing of larger container 12 by the salon client will increase the pressure within larger container 12, thus rupturing membrane 30 and allowing hair coloring solution 32 to be forced through applicator 14 and dispensed onto hair area 50.

Referring now to FIG. 3, a second embodiment of the device 10 of the present invention comprises first ampoule 18A of a first solution, such as hair colorant 22, and second ampoule 18B of a second solution, such as carrier 24, both contained within larger container 12. Larger container 12 further comprises a filter applicator 14, such as a cotton or other fiber filter, through which hair coloring solution 32 can be dispensed directly onto the chosen hair area 50 (see FIG. 9). As shown in this figure, filter applicator 14 has a flat application surface 40. Larger container 12 preferably is manufactured from a squeezable material so that larger container 12 can be squeezed to assist in dispensing hair color solution 32. Ampoules 18A, 18B preferably are manufactured from a breakable material such that ampoules 18A, 18B can be broken and their contents released into larger container 12. Connecting ring 16 in this example does not comprise membrane 30. Either connecting ring 16 has a puncturable lower wall 36 or larger container 12 has a puncturable upper wall 38, or both, which can be ruptured via pressure or via tube 34 (see FIG. 8). For example, after ampoules 18A, 18B are broken and hair colorant 22 is mixed with carrier 24 within larger container 12, further squeezing of larger container 12 by the salon client will increase the pressure within larger container 12, thus rupturing wall 36 or 38 or both and allowing hair coloring solution 32 to be forced through applicator 14 and dispensed onto hair area 50.

Referring now to FIG. 4, an alternative of the second embodiment of the device 10 of the present invention comprises first ampoule 18A of a first solution, such as hair colorant 22, and second ampoule 18B of a second solution, such as carrier 24, both contained within larger container 12. Also contained within larger container 12 is a third solution or liquid, such as an additional hair care product, such as for example hair conditioner 26. Larger container 12 further comprises a filter applicator 14, such as a cotton or other fiber filter, through which hair coloring solution 32 can be dispensed directly onto the chosen hair area 50 (see FIG. 9). As shown in this figure, filter applicator 14 has a tapered application surface 40. Larger container 12 preferably is manufactured from a squeezable material so that larger container 12 can be squeezed to assist in dispensing hair color solution 32. Ampoules 18A, 18B preferably are manufactured from a breakable material such that ampoules 18A, 18B can be broken and their contents released into larger container 12. Connecting ring 16 in this example comprises membrane 30, which can be ruptured via pressure or via tube 34 (see FIG. 8). For example, after ampoules 18A, 18B are broken and hair colorant 22 is mixed with carrier 24 and conditioner 26 within larger container 12, further squeezing of larger container 12 by the salon client will increase the pressure within larger container 12, thus rupturing membrane 30 and allowing hair coloring solution 32 to be forced through applicator 14 and dispensed onto hair area 50.

Referring now to FIG. 5, a third embodiment of the device 10 of the present invention comprises first ampoule 18A of a first solution, such as colorant 22, second ampoule 18B of a second solution, such as carrier 24, and one or more additional ampoules 18C of additional solutions such as conditioners 26, oils or other hair care products, all contained within larger container 12. Larger container 12 further comprises brush applicator 14 through which hair coloring solution 32 can be dispensed directly onto the chosen hair area 50 (see FIG. 9). As shown in this figure, brush applicator 14 has a flat application surface 40. Brush applicator 14 is of a known type, comprising bristles 42 attached to a porous or perforated base 44. Larger container 12 preferably is manufactured from a squeezable material so that larger container 12 can be squeezed to assist in dispensing hair color solution 32. Ampoules 18A, 18B, 18C preferably are manufactured from a breakable material such that ampoules 18A, 18B, 18C can be broken and their contents released into larger container 12. Connecting ring 16 in this example does not comprise membrane 30. Either connecting ring 16 has a puncturable lower wall 36 or larger container 12 has a puncturable upper wall 38, or both, which can be ruptured via pressure or via tube 34 (see FIG. 8). For example, after ampoules 18A, 18B, 18C are broken and hair colorant 22 is mixed with carrier 24 and conditioner 26 within larger container 12, further squeezing of larger container 12 by the salon client will increase the pressure within larger container 12, thus rupturing wall 36 or 38 or both and allowing hair coloring solution 32 to be forced through applicator 14 and dispensed onto hair area 50.

Referring now to FIG. 6, an alternative of the third embodiment of the device 10 of the present invention comprises first ampoule 18A of a first solution, such as colorant 22, second ampoule 18B of a second solution, such as carrier 24, and third ampoule 18C of and additional solution, such as conditioner 26, all contained within larger container 12. Also contained within larger container 12 is a fourth solution or liquid, such as an additional hair care product 28. Larger container 12 further comprises brush applicator 14 through which hair coloring solution 32 can be dispensed directly onto the chosen hair area 50 (see FIG. 9). As shown in this figure, brush applicator 14 has a tapered application surface 40. Brush applicator 14 is of a known type, comprising bristles 42 attached to a porous or perforated base 44. Larger container 12 preferably is manufactured from a squeezable material so that larger container 12 can be squeezed to assist in dispensing hair color solution 32. Ampoules 18A, 18B, 18C preferably are manufactured from a breakable material such that ampoules 18A, 18B, 18C can be broken and their contents released into larger container 12. Connecting ring 16 in this example comprises membrane 30, which can be ruptured via pressure or via tube 34 (see FIG. 8). For example, after ampoules 18A, 18B, 18C are broken and hair colorant 22 is mixed with carrier 24, conditioner 26 and fourth solution 28 within larger container 12, further squeezing of larger container 12 by the salon client will increase the pressure within larger container 12, thus rupturing wall 36 or 38 or both and allowing hair coloring solution 32 to be forced through applicator 14 and dispensed onto hair area 50.

Referring now to FIG. 7, a fourth embodiment of the device 10 of the present invention comprises larger container 12 having first compartment 60 containing a first solution, such as colorant 22, and second compartment 62 containing a second solution, such as carrier 24. Larger container 12 further comprises sponge applicator 14 through which hair coloring solution 32 can be dispensed directly onto the chosen hair area 50 (see FIG. 9). As shown in this figure, sponge applicator 14 has a flat application surface 40. Larger container 12 preferably is manufactured from a squeezable material so that larger container 12 can be squeezed to assist in dispensing hair color solution 32. Compartments 60, 62 preferably comprise a breakable, rupturable or puncturable top wall 64 that can be broken, ruptured or punctured and the contents of compartments 60, 62 released. Connecting ring 16 in this example comprises membrane 30, which can be ruptured via pressure or via tube 34 (see FIG. 8). For example, after top walls 64 are broken by the squeezing of larger container 12 by the salon client, hair colorant 22 is mixed with carrier 24 within connecting ring 16. Then, the salon client will increase the pressure within larger container 12 by further squeezing, allowing hair coloring solution 32 to be forced through applicator 14 and dispensed onto hair area 50. Alternatively, side walls 66, 68 of first compartment 60 and second compartment 62, respectively, can comprise a breakable, rupturable or puncturable material that can be broken, ruptured or punctured and the contents of compartments 60, 62 released and mixed within the now single compartment formed in larger container 12 when side walls 66, 68 rupture.

Referring now to FIG. 8, a sectional side view of the embodiment of the device 10 of the present invention shown in FIG. 3 with the two ampoules 18A, 18B broken and the solutions 22, 24 mixed in preparation for use is illustrated. In this illustrative example, the device 10 of the present invention comprises first breakable (shown as broken) ampoule 18A of a first solution, such as hair colorant 22, and second breakable (also shown as broken) ampoule 18B of a second solution, such as carrier 24, both contained within larger container 12. Larger container 12 further comprises a filter applicator 14, such as a cotton or other fiber filter, through which hair coloring solution 32 can be dispensed directly onto the chosen hair area 50 (see FIG. 9). As shown in this figure, filter applicator 14 has a flat application surface 40. Larger container 12 preferably is manufactured from a squeezable material so that larger container 12 can be squeezed by the user, as indicated by arrows S, to place pressure on and break ampoules 18A, 18B. Once ampoules 18A, 18B are broken, hair colorant 22 and carrier 24 mix within larger container 12 to form hair coloring solution 32. Connecting ring 16 in this example does not comprise membrane 30. Either connecting ring 16 has a puncturable lower wall 36 or larger container 12 has a puncturable upper wall 38, or both, which can be ruptured via pressure or via tube 34. For example, after ampoules 18A, 18B are broken and hair colorant 22 is mixed with carrier 24 within larger container 12, connecting ring 16 can be screwed or otherwise placed onto the top of larger container 12 such that tube 34, shown with a piercing end 70, punctures lower wall 36, upper wall 38, or both, or membrane 30 if a membrane 30 configuration is used. Further squeezing of larger container 12 by the salon client will increase the pressure within larger container 12, thus allowing hair coloring solution 32 to be forced through applicator 14 and dispensed onto hair area 50. Tube 34 can be attached to connecting ring 16 via struts 72 or the like.

FIG. 9 illustrates an alternative embodiment of the present invention showing an elongated larger container 12 structured to receive and hold two ampoules 18A, 18B in a stacked relationship.

Referring now to FIG. 10, the present invention further comprises a method for applying hair coloring solution 32 to a chosen hair area on the salon client. Several exemplary methods are disclosed with general reference to FIGS. 1-9 and specific reference to FIG. 10.

A first embodiment of the method of the present invention comprises the steps of (1) providing a device 10 having at least one breakable ampoule 18 of a first solution 22, such as the colorant, contained within a larger relatively flexible container 12 also containing a second solution, such as a carrier 24; (2) breaking the ampoule 18 so as to release the first solution 22 into the larger container 12; (3) mixing the first solution 22 with the second solution 24 within the larger container 12 so as to produce a permanent hair color solution 32; and (4) squeezing the larger container 12 to dispense the hair color solution 32. The larger container 12 further comprises a brush or sponge like filter applicator 14 through which the hair coloring solution 32 can be dispensed directly onto the chosen hair area 50. Larger container 12 preferably is manufactured from a squeezable material so that the larger container 12 can be squeezed to break ampoule 18 and to assist in dispensing the hair color solution 32. The ampoule 18 preferably is manufactured from a breakable material such that the ampoule 18 can be broken and its contents released into the larger container 12.

A second embodiment of the method of the present invention comprises the steps of (1) providing a device 10 having at least two breakable ampoules 18A, 18B, a first ampoule 18A of a first solution 22, such as the colorant, and a second ampoule 18B of a second solution, such as a carrier 24, with both ampoules 18A, 18B being contained within a larger relatively flexible container 12; (2) breaking the ampoules 18A, 18B so as to release the first solution 22 and the second solution 24 into the larger container 12; (3) mixing the first solution 22 with the second solution 24 within the larger container 12 so as to produce a permanent hair color solution 32; and (4) squeezing the larger container 12 to dispense the hair color solution 32. The larger container 12 further comprises a brush or sponge like filter applicator 14 through which the hair coloring solution 32 can be dispensed directly onto the chosen hair area 50. Larger container 12 preferably is manufactured from a squeezable material so that the larger container 12 can be squeezed to break ampoules 18A, 18B and to assist in dispensing the hair color solution 32. The ampoules 18A, 18B preferably are manufactured from a breakable material such that the ampoules 18A, 18B can be broken and their contents 22, 24 released into the larger container 12.

A third embodiment of the method of the present invention comprises the steps of (1) providing a device 10 having at least two ampoules 18A, 18B, a first ampoule 18A of a first solution 22, such as the colorant, a second ampoule 18B of a second solution 24, such as a carrier, and either (a) a third ampoule 18C of a third solution 26, such as a conditioner, oil or other hair care product or (b) a conditioner, oil or other hair care product, all contained within a larger relatively flexible container 12; (2) breaking the ampoules 18A, 18B, 18C so as to release the first solution 22, the second solution 24, and, if the third solution 26 is contained in an ampoule 18C, the third solution 26 into the larger container 12; (3) mixing the first solution 22, the second solution 24, and the third solution 26 within the larger container 12 so as to produce a permanent hair color solution 32; and (4) squeezing the larger container 12 to dispense the hair color solution 32. The larger container 12 further comprises a brush or sponge like filter applicator 14 through which the hair coloring solution 32 can be dispensed directly onto the chosen hair area 50 and preferably is manufactured from a squeezable material so that the larger container 12 can be squeezed to break ampoules 18A, 18B, 18C and to assist in dispensing the hair color solution 32. The ampoules 18A, 18B, 18C preferably are manufactured from a breakable material such that the ampoules 18A, 18B, 18C can be broken and their contents 22, 24, 26 released into the larger container 12. This third embodiment also can have four or more ampoules 18 and/or solutions 22, 24, 26, 28.

The device 10 can be prepared at the salon with each of the various parts of the device 10 being supplied separately and then combined at the salon in a desired configuration. For example, the salon professional can take one of larger containers 12 and insert one or more ampoules 18 of hair colorant or colorants 22, carrier 24 and/or additional solutions into larger container 12. Additionally, one of the solutions can be poured into larger container 12 if desired. Then a connecting ring 16 and/or applicator 14 can be attached to larger container 12 and the completed device 10 given or sold to the salon client. In this manner, the device can be a custom made hair regrowth touch up device or kit.

The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

What is claimed is:

1. A device for applying color to hair comprising:

(a) a larger container made from a flexible material and having a closed bottom and sides and an open top;

(b) a first ampoule contained within the larger container, wherein the first ampoule contains a hair colorant;

(c) a second ampoule contained within the larger container, wherein the second ampoule contains a catalyst useful for formulating a hair coloring solution from the hair colorant;

(d) an applicator for applying the hair colorant to hair, the applicator being separate from said larger container;

(e) a connecting ring capable of releasably connecting the open top of the larger container with the applicator, the connecting ring being releasably connected to both of said applicator and said larger container, and comprising a rupturable sealing membrane, wherein rupturing the first ampoule and the second ampoule allows the hair colorant to mix with the catalyst to form the hair coloring solution and rupturing the sealing membrane allows the hair coloring solution to be dispensed from the applicator.

2. The device for applying color to hair as claimed in claim 1, further comprising a mixing ball.

3. The device according to claim 1, wherein the hair colorant is prepackaged in the first ampoule.

4. The device according to claim 1, wherein the catalyst is prepackaged in the second ampoule.

5. The device according to claim 4, wherein the catalyst is selected from the group consisting of peroxide, ammonia and other known carriers and catalysts.

6. The device according to claim 4, wherein the catalyst is a peroxide, and the combination of the hair colorant and the peroxide produces a permanent hair coloring solution.

7. The device according to claim 1, further comprising an additional hair care product contained in the larger container or in a third ampoule.

8. The device according to claim 7, wherein the additional hair care product is selected from the group consisting of conditioners, oils, crèmes, dyes, tints, lotions, bleaches, and mousses.

9. The device according to claim 1, wherein the larger container has a length between approximately 1 inch and 4 inches, and a diameter or width between approximately ¼ inch and 1 inch, and is structured to hold and contain liquids.

10. The device according to claim 9, wherein the flexible material of the larger container is such that the larger container can be squeezed to dispense the hair colorant.

11. The device according to claim 9, wherein the ampoules are relatively small breakable vials and are of such a size that at least two of the ampoules fit within the hollow interior of the larger container.

12. The device according to claim 1, wherein the applicator is manufactured from a material that will allow the hair colorant contained within the larger container to travel through the applicator in a controlled manner.

13. The device according to claim 12, wherein the applicator is selected from the group consisting of sponges, brushes, and filters that can be used as fluid or solution applicators.

14. The device according to claim 1, wherein the connecting ring releasably connects the applicator to the larger container with integral screw threads disposed on said connecting ring or through friction.

15. The device according to claim 14, wherein the connecting ring is a ring-like structure having a side wall and no top or bottom walls and the rupturable sealing membrane is attached to the connecting ring about an internal circumference or perimeter of the connecting ring, whereby the rupturable sealing membrane seals the larger container closed prior to being ruptured.

16. A device for applying color to hair comprising:

(a) a larger container made from a flexible material and having a hollow interior, a closed bottom and sides, an open top, a length between approximately 1 inch and 4 inches, a diameter or width between approximately ¼ inch and 1 inch, and is structured to hold and contain liquids;

(b) a first ampoule contained within the larger container, wherein the first ampoule contains a hair colorant, and wherein the first ampoule is a relatively small breakable vial filled with the hair colorant in solution or liquid form and is of such a size that the first ampoule fits within the hollow interior of the larger container;

(c) a second ampoule contained within the larger container, wherein the second ampoule contains a catalyst useful for formulating a hair coloring solution from the hair colorant, and wherein the second ampoule is a relatively small breakable vial filled with the hair catalyst in solution or liquid form and is of such a size that the second ampoule fits within the hollow interior of the larger container;

(d) an applicator separate from said larger container manufactured from a material that will allow the hair coloring solution to travel through the applicator in a controlled manner for applying the hair coloring solution to hair; and (e) a connecting ring releasably connecting the open top of the larger container and the applicator, said connecting ring being releasably connected to both of said applicator and said larger container, and the connecting ring comprising a rupturable sealing membrane, wherein rupturing the first ampoule and the second ampoule allows the hair colorant to mix with the catalyst to form the hair coloring solution and rupturing the sealing membrane allows the hair coloring solution to be dispensed from the applicator.

17. The device according to claim 16, wherein the catalyst is selected from the group consisting of peroxide, ammonia and other known carriers and catalysts.

18. The device according to claim 17, further comprising additional hair care products contained in the larger container or in a third ampoule.

19. The device according to claim 18, wherein the additional hair care product is selected from the group consisting of conditioners, oils, crèmes, dyes, tints, lotions, bleaches, and mousses.

20. The device according to claim 16, wherein the flexible material of the larger container is such that the larger container can be squeezed to dispense the hair coloring solution.

21. The device according to claim 20, wherein the applicator is selected from the group consisting of sponges, brushes, and filters that can be used as fluid or solution applicators.

22. The device according to claim 21, wherein the connecting ring connects the applicator to the larger container with integral screw threads disposed on said connecting ring or through friction.

23. The device according to claim 22, wherein the connecting ring is a ring-like structure having a side wall and no top or bottom walls and the rupturable sealing membrane is attached to the connecting ring about an internal circumference or perimeter of the connecting ring, whereby the rupturable sealing membrane seals the larger container closed prior to being ruptured.

24. A method for applying color to hair comprising the steps of:

(a) providing a device having a first breakable ampoule of a hair colorant and a second breakable ampoule of a catalyst useful for formulating a hair coloring solution from the hair colorant contained within a larger relatively flexible container;

(b) breaking the first ampoule and the second ampoule so as to release the hair colorant and the catalyst into the larger container;

(c) mixing the hair colorant and the catalyst to form a hair coloring solution;

(d) rupturing a rupturable sealing membrane connected to and located in a connecting ring releasably connected to both an open top of the larger container and an applicator, said connecting ring further located between said applicator and the first and second ampoules, wherein rupturing the sealing membrane allows the hair coloring solution to be dispensed from the larger container; and (e) squeezing the larger container to dispense the hair coloring solution, wherein the applicator further comprises a separate brush or sponge-like filter applicator through which the hair coloring solution is dispensed directly onto a chosen hair area.

* * * * *